US005207084A

United States Patent [19]

West et al.

[11] Patent Number: 5,207,084

[45] Date of Patent: May 4, 1993

[54] SEVERING CONTINUOUS-LENGTH WIRE

[75] Inventors: H. William West; Millard F. Vannoy, Jr., both of Cambridge, Md.

[73] Assignee: Shanley and Baker, Washington, D.C.

[21] Appl. No.: 762,542

[22] Filed: Sep. 18, 1991

Related U.S. Application Data

[63] Continuation of Ser. No. 529,147, May 25, 1990, abandoned.

[51] Int. Cl.[5] ..... B21G 3/16; B21G 3/22

[52] U.S. Cl. ..... 72/325; 72/407; 470/40; 470/160; 470/195

[58] Field of Search ..... 72/325, 324, 407, 416; 10/31.35, 34, 53, 59, 61, 70, 9, 21, 24, 49, 50, 43; 140/140; 470/40, 160, 195

[56] References Cited

U.S. PATENT DOCUMENTS

| | | | |
|---|---|---|---|
| 231,254 | 8/1880 | Baackes . | |
| 231,255 | 8/1880 | Baackes | 10/53 |
| 353,585 | 11/1886 | Philips | 10/49 |
| 393,482 | 11/1888 | Philips | 10/49 |
| 393,519 | 11/1888 | Rogers | 10/53 |
| 861,289 | 7/1907 | Jones | 10/35 |
| 1,138,211 | 5/1915 | Graham | 10/59 |
| 1,774,915 | 9/1930 | Crane | 10/59 |
| 1,925,845 | 9/1933 | Moore . | |
| 2,101,860 | 12/1937 | Lewis | 140/140 |
| 2,175,228 | 10/1939 | Stronach . | |
| 2,286,956 | 6/1942 | Dillon . | |
| 2,903,720 | 9/1959 | James . | |
| 3,362,035 | 1/1968 | Faulkner | 10/49 |
| 3,398,413 | 8/1968 | Skierski . | |
| 3,728,888 | 4/1973 | Motzer | 72/325 |
| 4,184,217 | 1/1980 | Dohi | 10/9 |
| 4,342,127 | 8/1982 | Weaver | 10/57 |

FOREIGN PATENT DOCUMENTS

| | | | |
|---|---|---|---|
| 27047 | 8/1971 | Japan | 10/31 |

*Primary Examiner*—Daniel C. Crane
*Attorney, Agent, or Firm*—Raymond N. Baker

[57] ABSTRACT

Continuous length wire is segmented into predetermined lengths having desired die-coined configurations at severed longitudinal ends in a wire-working machine of the invention. In a single step operation, such wire is simultaneously die-coined and severed to form a longitudinally contiguous pair of wire ends in order to produce such predetermined lengths with desired tapered convex shapes at each longitudinal end ready for use as shaped and severed so as to eliminate subsequent metal-forming steps and certain problems associated with severing practices of the prior art. In a specific embodiment of the fabrication process, coiled wire is straightened and then simultaneously die-coined and severed to form rigid rods with tapered end configurations which facilitate use as a connecting rod during assembly operations, e.g. in the assembly of a metal wire belt. The application also discloses specific embodiments of dies for such process, methods of producing such dies, and die-drive apparatus for moving such dies together for such single step operation and then apart for a subsequent operation.

8 Claims, 5 Drawing Sheets

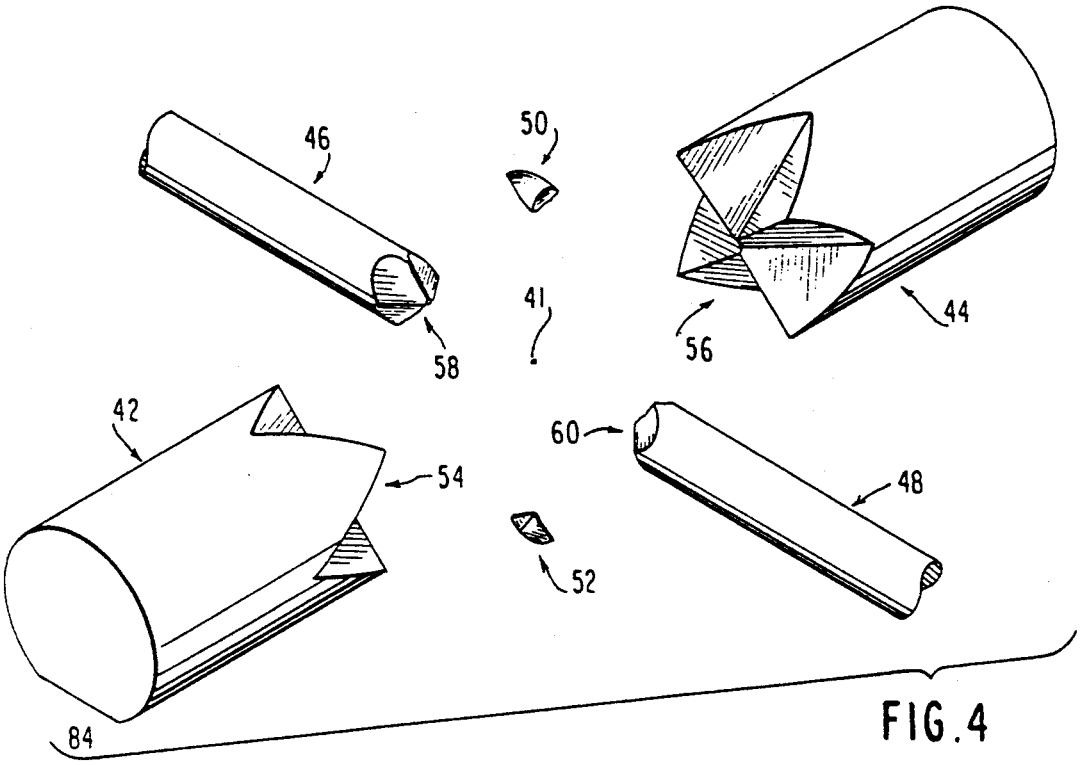
FIG. 4
FIG. 5
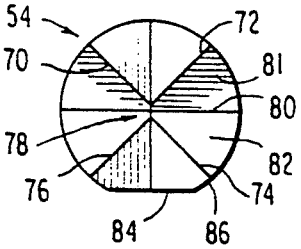
FIG. 6
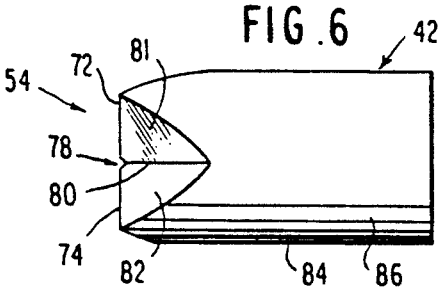
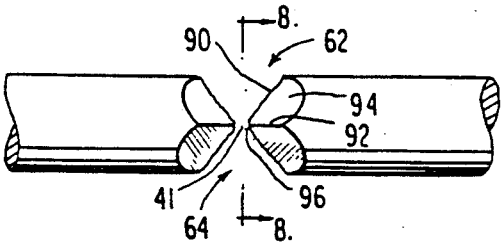
FIG. 7
FIG. 8
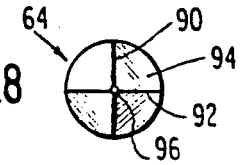

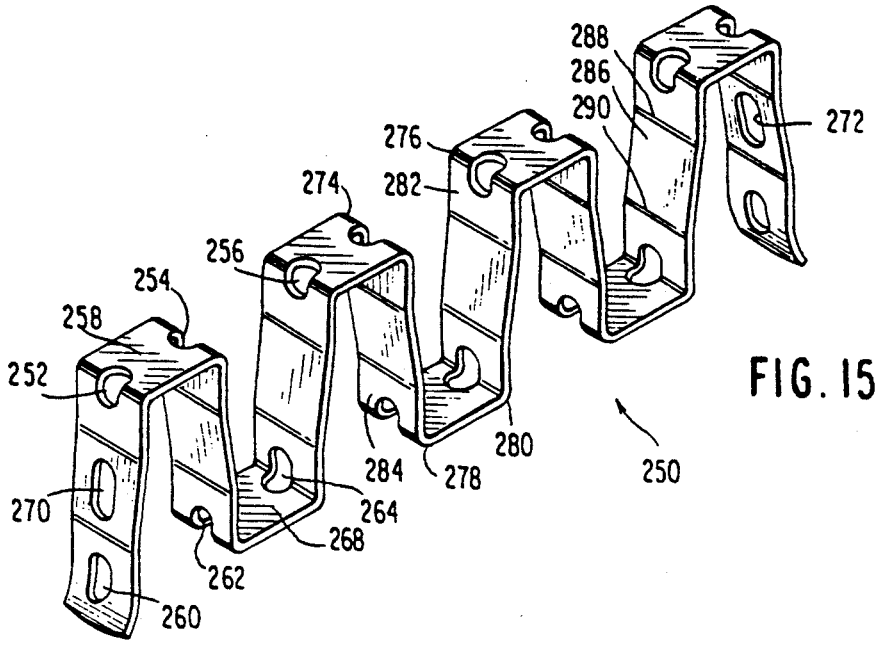
FIG. 15
FIG. 16
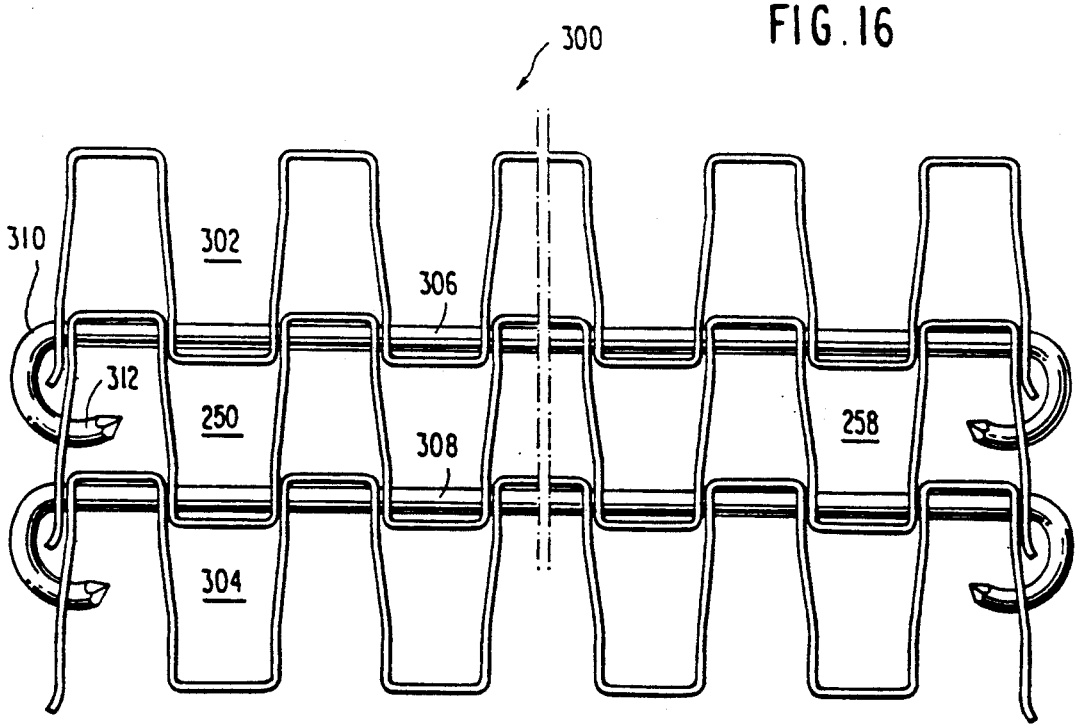

SEVERING CONTINUOUS-LENGTH WIRE

This is a continuation of application Ser. No. 07/529,147, filed May 25, 1990, the entire disclosure of which is incorporated herein by reference, now abandoned.

This invention relates to segmenting continuous length wire into predetermined lengths having desired die-coined configurations at severed longitudinal ends. More particularly, the invention is concerned with single step simultaneous die-coining and severing continuous length wire to form a longitudinally contiguous pair of wire ends in order to produce such predetermined lengths with desired tapered convex shapes at each longitudinal end ready for use as shaped and severed so as to eliminate subsequent metal-forming steps and certain problems associated with severing practices of the prior art.

In a specific embodiment of the invention, coiled wire is straightened and then simultaneously die-coined and severed to form rigid rods of predetermined length with tapered end configurations which facilitates usage as a connecting rod during assembly operations, e.g. in the assembly of a metal wire belt.

Severing of such wire belt connector rods has previously been limited to a guillotine type cutting action. The resulting flat-faced end, often with burrs, presented difficulties during assembly of metal wire belts; and limited to manual assembly.

Other applications of severed wire required subsequent wire end shaping steps after such severing before final usage.

Decreased costs, increased productivity and more efficient subsequent assembly result from the present invention.

Other advantages and contributions are considered in more detail in describing the prior art practice and embodiments of the invention shown in the accompanying drawings.

In such drawings:

FIG. 4 is an exploded perspective view illustrating a pair of coining and severing dies of the invention in retracted position after simultaneously die-coining and severing a wire to form tapered ends in longitudinally contiguous relationship;

FIGS. 5 and 6 are end and side views of an embodiment of a die for forming a tapered end illustrating selective features of such die;

FIG. 7 is a side view of the severed ends using the embodiment of FIGS. 5 and 6;

FIG. 8 is an end view of a die-coined rod end taken along the lines 8—8 of FIG. 7.

FIG. 15 is a perspective view of a "flat-wire" grating member for illustrating a specific application of the invention in metal wire belt assembly, and, FIG. 16 is a plan view of a section of continuous "flat-wire" metal belt illustrating a specific application and product of the invention.

Figure 2:
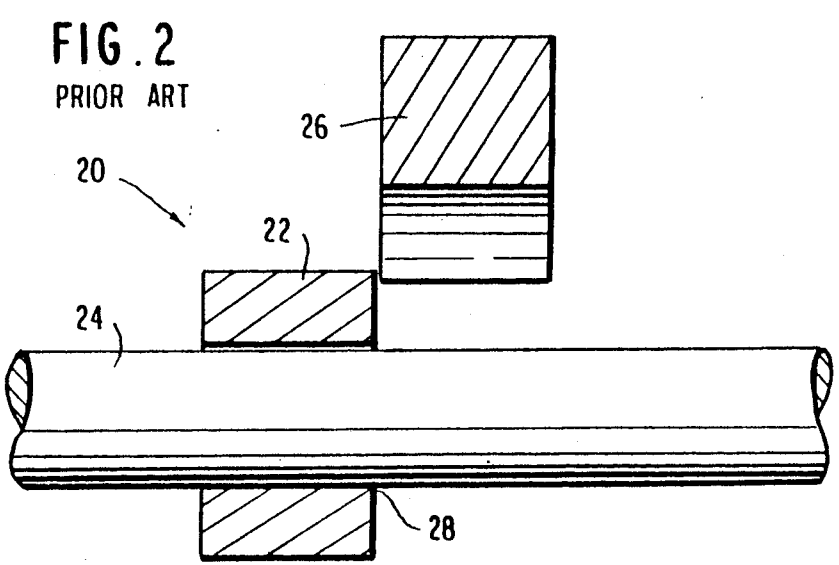
FIG. 2 PRIOR ART
FIGS. 1 and 2 are schematic views, partly in cross section, of prior art rod shearing apparatus as used in wire-working-machinery.
Figure 1:
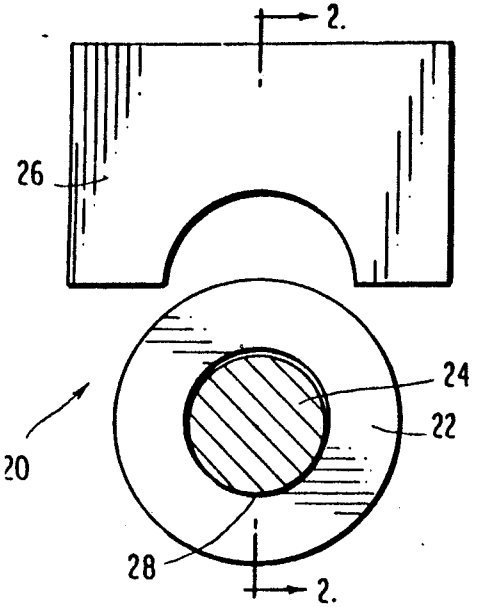
FIG. 1 PRIOR ART

The prior art guillotine-type rod shearing apparatus 20 of FIGS. 1 and 2 utilizes a feed guide member 22 defining a circular aperture through which continuous wire 24 moves and is positioned for shearing. Guillotine blade 26 moves vertically downwardly, as indicated in FIG. 2, through the wire shearing to produce rods with flat-faced longitudinal ends.

Typically, blade 26 cuts through about 80 to 95% of the diameter of wire 24 when the remaining portion fractures; such fracture often results in a burr which protrudes from the wire beyond its circumferential periphery, for example at or near location 28.

Such prior art flat-faced rod ends are difficult to use in any assembly requiring passage of such rods longitudinally through more than one opening; for example, when used as connector rods in assembly of metal wire-belts.

Such connecter rods must now be manually fed through rows of apertures, across the width of the belt, to connect adjacent spiral-wire components or flat-wire components to assemble a longitudinally-continuous wire belt. The apertures presented by such wire components are difficult to align precisely and, passage of such flat-faced rod is readily obstructed when slight misalignment of the apertures causes the flat leading face at the longitudinal end of the rod to impact the edge of such aperture; and protruding burrs of such guillotine cut ends aggravate the problem.

The die-coined convex tapered rod ends of the invention result in self aligning and help to align the wire components as the rods are pushed through the apertures; thus assembly is faster, and more efficient; and automation of such assembly becomes practicable.

The rods of the invention, fabricated with longitudinal ends of desired configuration, supplant prior art rods for other uses as well by eliminating the need for additional metal-forming steps conventionally required to reconfigure flat-faced ends for other uses in prior practice.

Figure 3:
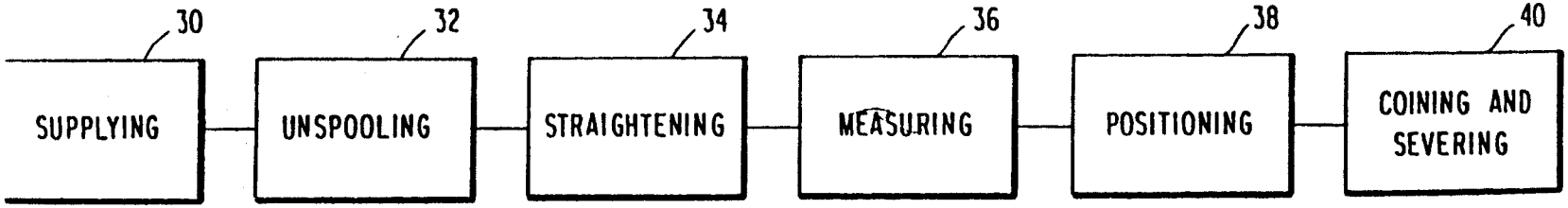
FIG. 3 is a diagrammatic presentation for describing a specific embodiment of a continuous-line process of the invention for fabricating straight metal rods with longitudinal ends ready for use as delivered from such line.

In the continuous-line process of FIG. 3, wire is supplied at stage 30 moving longitudinally in the direction of its length into the process line. Typically wire (e.g. round or other compact geometric cross section) is supplied in coil form and may require an uncoiling stage 32 and a straightening stage 34. Straightening so as to provide desired longitudinally rigid properties can be carried out by cold working sufficient for intended usage.

Measuring stage 36 determines a location for severance along the longitudinal direction of movement of the wire; at positioning stage 38, the wire is properly oriented between two dies which move toward each other from opposite sides of the wire to die-coin and severe the wire at stage 40 to form rods.

As taught herein, die-coining and severing take place simultaneously in a single step operation in which tooling dies are driven together from opposite sides of the wire. Severing and die-coining actions occur simultaneously with final wire severance completing both actions. Two longitudinally contiguous die-coined and severed ends of predetermined shape are simultaneously formed one on each longitudinally sides of such final severance location. The center of such final severance in the embodiment of FIG. 4 is indicated by reference numeral 41 near the intersection of the longitudinal centerlines of the tooling dies and the wire.

The coiled wire can be straightened in an elongated rotary-arbor type of wire straightener which typically rotates continuously bending the wire cyclicly in all lateral directions as the arbor rotates. Such cold-working straightens the wire; however, in a continuous-line forming operation, any significant interruption of longitudinal movement of the wire for cutting beyond a very limited and prescribed interval depending upon arbor RPM damages or breaks the wire due to embrittlement. Thus, fast-acting severance is required.

The tooling-drive apparatus of the present invention provides for direct substitution into existing wire-working-machinery which rely on the prior art guillotine-type cutting; such wire-working-machinery for unspooling, straightening, measuring, positioning and guillotine cutting have been provided commercially by Shuster-Mettler Corporation P.O. Box 883, New Haven, Conn. 06504 or, Lewis Machine Company 3441 East 76th Street, Cleveland, Ohio 44127, with typical wire feed rate of 150 feet per minute. In such machinery wire from about 1/16 inch to about ¼ inch diameter has typically been cut into lengths between 1 foot and 20 feet long for use in the manufacture of metal wire belts. Wire for other purposes is similarly produced with significantly greater diameter depending on the metal and cutting force available.

The guillotine cutter and drive-mechanism for such high-speed wire-belt rod cutter apparatus of the above identified commercial machinery are readily supplanted by tooling dies and tooling-drive apparatus of the present invention. Specific embodiments of the invention (shown and described) enable production of rods with die-coined and severed ends at rates equal to and/or in excess (for reasons explained later) of the rates which have been available with the flat-end, guillotine-type cutting mechanism(s) of the prior art.

The exploded perspective view of FIG. 4 illustrates the arrangement of tooling dies, wire, and ejected coined pieces resulting from the simultaneous die-coining and severing action in accordance with the invention. Tooling dies 42,44 are shown in retracted position on diametrically opposite lateral sides of wire 46,48 after completion of the die-coining and severing operation.

Die-surfaces 54,56, of tooling dies 42,44 confront the center of the boundary between the continuous-length wire 46 and the severed segment 48 at 41. Tooling 42,44 are driven together through the wire simultaneously from its opposite sides, and then retracted simultaneously. Such forming and retracting are carried out by a single stroke mechanism described in relation to later figures; during severing and retraction the tooling dies move approximately one-half the distance that the guillotine blade moves and the interruption in longitudinal movement of the wire can be decreased. In fact with the tapered end longitudinal movement of wire can continue before full retraction of the tooling dies from the circumferential periphery of the wire, so that less than half the previous delay interval is required.

Wire ends 58,60 are illustrated in exploded positions; in practice, immediately after severance such severed pair of longitudinal ends confront each other contiguously on longitudinally-opposite sides of the boundary between such wires at 41.

During the forming operation, die-coined separate pieces 50,52 of predetermined shape are severed from the sides of the wire at locations adjacent to such central point.

Generally, the central point of the wire boundary 41 is located at the intersection point of the central-longitudinal-axes of the dies and the central-longitudinal-axis of the wire; shapes other than those symmetric about the center-line of the wire as in FIG. 4, the die-coined separate pieces can have a differing configuration and the central point 41 can be other than the centerline intersection point.

Confronting die surfaces 54,56 of tooling dies 42,44 present forming-surfaces as seen in FIG. 4. Coining-regions of the dies recessed inwardly from the severing edges at longitudinal confronting ends of the tooling dies are described in more detail in relation to later figures. When the tooling dies are driven toward each other through the wire, each such severing-edge approaches and meets a mirror-image severing-edge of the confronting die to sever the wire. In the embodiment described in relation to FIGS. 4–8 the dies contain mirror-image coining and severing configurations which form a pair of longitudinally contiguous identical wire ends on each side of the boundary between the two wires. The simultaneous die coining and severing action to form both such longitudinally contiguous ends is not limited to such identical end configuration nor to mirror image die surfaces.

The die-coining operation applies sufficient force to the wire such that the metal of the wire flows to fill the shape of the coining-regions of the die. However, in a preferred embodiment, severing edges of the dies are positioned and shaped so that the wire fractures near the wire centerline, prior to full coining of that point, this forms a convex-tapered end configuration but with a blunted tip (where fracture occurs); the purpose is to avoid a sharp point at each end of the rod—at least partially for safety reasons during handling.

FIGS. 5 and 6 present elevational views of a specific embodiment of the dies of FIG. 4. The four chisel-shaped severing-edges 70,72,74,76 of tooling die 42, (which are a mirror image of those on tooling die 44) form an "X-shaped" configuration of severing edges in a plane perpendicular to the longitudinal axis of the tooling die. In such specific embodiment, severing-edges 70,72 intersect to form an angled V-shaped edge which is separated at its apex from the apex of a second V-shaped angled edge, such separation is at the central-longitudinal-axis of the tooling dies. The apexes of such V-shaped severing-edges point toward each other and can be predeterminedly separated by "notch" spacing 78; the separation distance determines the bluntness of the tip of the tapered convex configuration of each wire end.

A typical coining-region is defined by two flat coining-surfaces 81,82 which extend inwardly from severing-edges 72,74 and intersect to define a recessed concave edge 80 (FIGS. 5 and 6).

The preferred tooling indexing surface 84 (FIGS. 4–6) and the circumferential periphery 86 of the tooling communicate with a tool-holder shown and described in relation to later figures; such indexing means assures that each tooling die surface is installed and presented in the correct orientation for the intended coaction with another die surface for the coining end severing operation.

Preferably the tooling is made from sinter-hardened machineable tooling material, e.g. carbides such as tungsten carbide, certain ceramics, hardened alumina, or nitrides such as the cubic form of boron nitride. Electrical-discharge-machining is a preferred method of producing the forming surfaces 54,56 because of the intricate angled relationships and the difficulties in machining such surfaces by more conventional mechanical means.

FIGS. 7 and 8 illustrate a desired convex-taper, slightly blunted, diamond-shaped configuration for the ends 58,60 (best seen in FIGS. 4 and 7) produced by the die surface embodiment of FIGS. 4 and 6. Between edges 90 and 92 of the tapered convex configuration (FIG. 8) lies planar die-coined surface 94 typical of four such surfaces which form a diamond-shaped end configuration with blunted tip 96.

Figure 9:
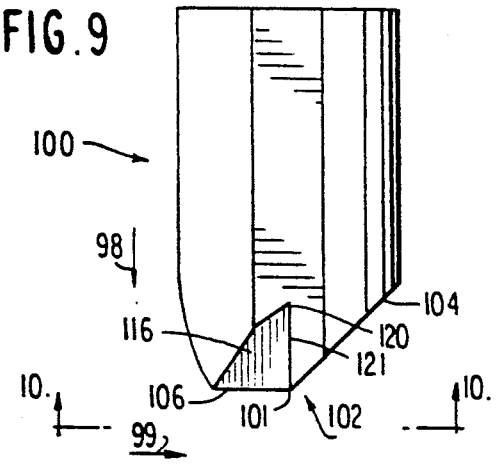
FIG. 9 is a top plan view of another specific embodiment of a die viewed during its movement toward a corresponding mirror-image die converging toward the wire to be die formed and severed.
Figure 10:
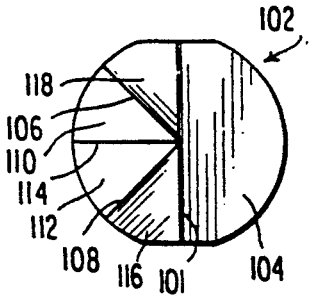
FIG. 10 is an end view of the die of FIG. 9 in accordance with the invention.

The invention also enables simultaneous coining and severing of wire to provide differing configurations on opposite sides of the severance location; and, therefor at opposite longitudinal ends of the rods being formed. FIG. 9 is a plan view from above of tooling die 100 for such purpose of providing different wire end configurations; and FIG. 10 is an end view of such tooling die.

In such embodiment, a single severing-edge 101 is diametrically oriented and bisects the forming-surface-plane 102 to form the boundary of semi-ovular coining region 104. The remaining half of the forming surface is divided by two severing-edges 106,108 which radiate from the longitudinal centerline of the die. Such severing edges divide such remaining half of the forming-surface into three coining regions; with one coining-region between severing-edges 106,108 being defined by planar coining surfaces 110,112 that extend inwardly from the severing edges to intersect at recessed convex edge 114. The two remaining coining-regions are identical to each other. Typically the coining-region between severing-edges 106 and 101 comprises planar coining-surfaces 116,118 that extend inwardly to intersect at recessed convex edge 120. Planar coining-surfaces 110,112,116 have equal angles of recession from the longitudinal end of the die, and coining-surface 118 forms a plan parallel to the central-longitudinal-axis of the tooling die.

Figure 11:
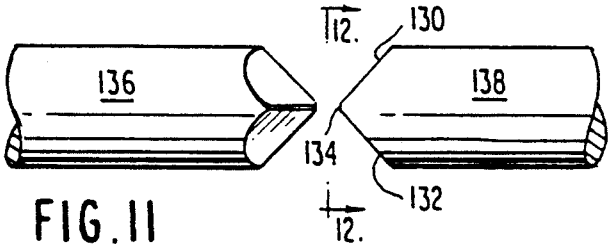
FIG. 11 is a top plan view of severed ends such wire resulting from use of pair of dies moving as described in relation to FIG. 10.

Tooling dies (such as 100), with their coining surfaces and severing edges in confronting relationship, move toward each other as indicated by arrow 98 (FIG. 9) and sever a wire moving as indicated by arrow 99 (FIG. 9 and 11).

Figure 12:
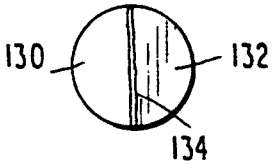
FIG. 12 is an end view of one severed end taken along lines 12—12 of FIG. 11.

As shown by FIG. 11, the trailing longitudinal end of wire 128 is severed in a wedge shape; with wedge surfaces 130,132 intersecting to form diametrically oriented edge as indicated at 134 (FIG. 12).

The leading longitudinal end of wire 136 (FIG. 11) has a tapered diamond-shaped configuration which corresponds generally to the configuration formed on each longitudinal end by the tooling dies of FIG. 4–6.

In the light of the above teachings on separate embodiments of the invention, other die configurations for utilizing the simultaneous die-coining and severing actions should be available to those skilled in the art so as to produce adjacent pairs of preselected-configuration ends in a single fabrication step so as to eliminate further metal-forming steps for such ends and so as to provide for various uses for such rods.

Figure 13:
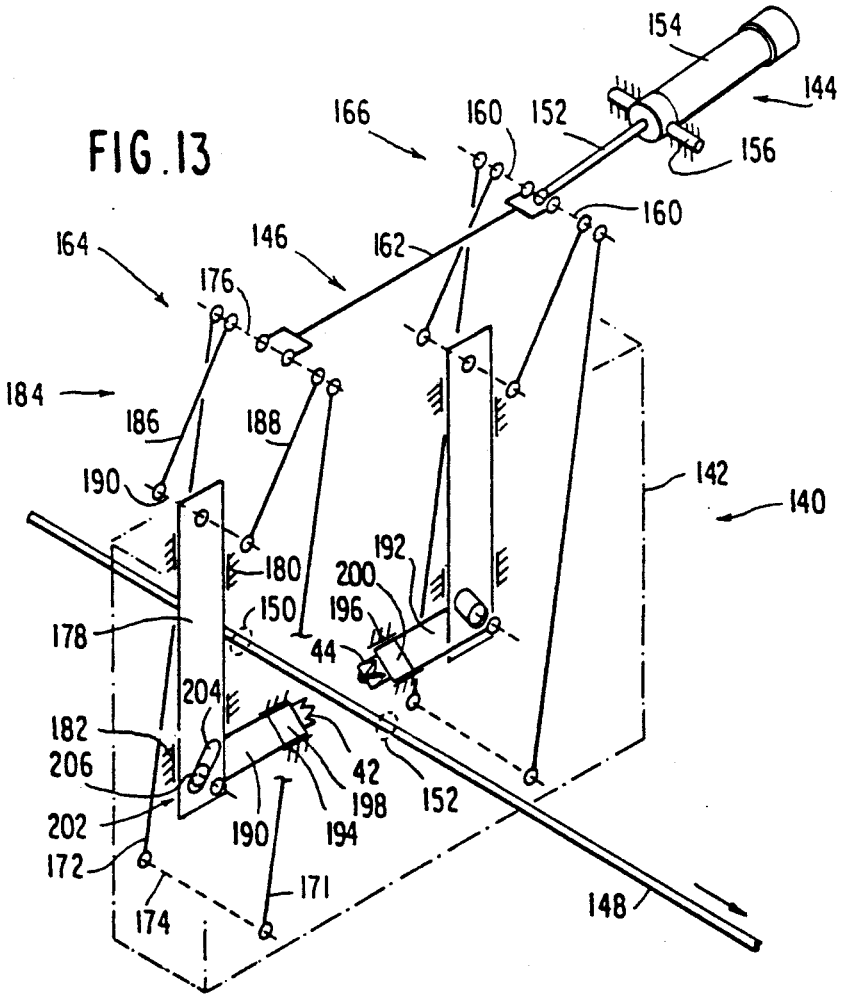
FIG. 13 is a schematic perspective view of fast-acting tooling drive apparatus of the invention providing single-stroke action moving a pair of dies of the invention to simultaneously die-coin and severe wire to form a contiguous pair of finished wire end configurations.
Figure 14:
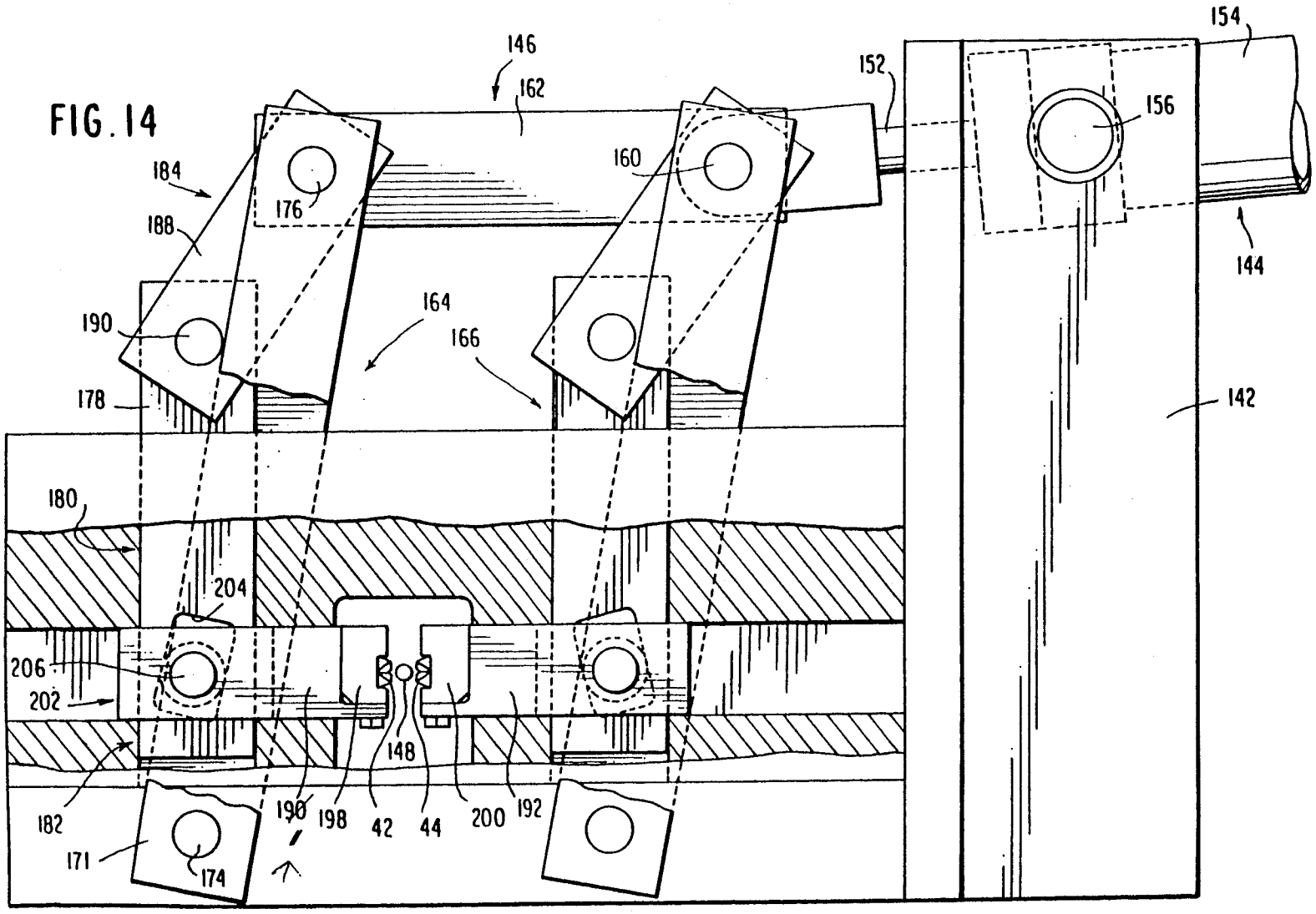
FIG. 14 is an enlarged side view of a portion of a specific embodiment of the preferred fast-acting tooling drive apparatus of FIG. 13.

Fast-acting tooling-drive apparatus to move the tooling dies of the invention together and apart is an important contribution of the invention for continuous production line operations. Referring to FIGS. 13 and 14, tooling-drive apparatus 140 includes stationary base 142 to support moving parts of drive apparatus including prime-mover means 144, and mechanical-linkage means 146, and to position wire 148.

Wire 148 is fed in the direction indicated in FIG. 13 through support aperture 150,152, in base 142 so as to position the wire in a proper orientation for die-coining and severing by movement of the tooling dies 42,44 toward each other in a direction which is transverse to the central-longitudinal-axis of the wire.

A single-stroke of piston rod 152 of prime-mover means 144 (which, e.g. can be hydraulically or pneumatically operated) generates force and movement transferred by mechanical linkage 146 to drive the tooling both toward each other and then apart rapidly; completing a coining and severing action and enabling continued passage of the wire. A typical hydraulically operated prime-mover includes a cylinder 154 which is pivotally mounted at 156 to permit toggle-action drive by piston rod 152.

The mechanical-linkage provides the toggle-action drive for the tooling, toward and away from each other, with one unidirectional piston stroke completing coining, severing and retraction of the tooling. The next unidirectional piston stroke in the opposite direction of the original stroke again completing another coining, severing and tooling retraction cycle.

The working end of the piston rod is connected through hinge means 160, to mechanical-linkage 146 to impart such reciprocal (severing and retraction) motions to the tooling 42,44. Mechanical-linkage 146 includes distribution-member 162 that coordinates simultaneous movement of such tooling dies and simultaneously distributes reciprocal motion and force separately to each of two similar die-drive-linkages 164,166 which transfer such reciprocal motion and force to move each tooling die.

The distribution-member is supported and its movement restrained by a rocking parallelogram frame comprising two supporting members. Each supporting-member typically comprises two beams 171,172, each beam having one end hinged 174 to base 142, and the distal ends hinged 176 to one end of the distribution-member so that the hinge-joints restrict movement of the distribution-member to the plane defined by the distribution and supporting members. The supporting-members are equal length and parallel and the amplitude of the reciprocal motion is much shorter than the length of the supporting-members such that the movement of distribution-member 162 is restrained to reciprocal translation in substantially axial direction.

Two similar die-driving-linkages 164,166 transfer motion from distribution-member 162 to the die-holders. Intermediate-members typical of 178, shown vertically oriented, are laterally restrained to slide in reciprocal axial translation by slideways 180,182 within stationary framework 142. Each die-driving-linkage includes a toggle-means typical of 184 comprising a toggle-member, shown as beams 186,188, hinged 176 at one end to distribution-member 162 and hinged 190 at the distal end an end of intermediate-member 178.

Each toggle-means is oriented with the distributing-member and an intermediate-member to comprise a toggle-mechanism to cam the motion from one direction to another while providing mechanical advantage to multiply the associated force. The toggle-member must be shorter than the supporting-members for proper cam action. The toggle-mechanism drives the intermediate-members both forwards and backwards with each unidirectional stroke (either forward or backward) of the distributing-member.

Die-holding-members 190,192, shown horizontally oriented, are located along a mutual central-longitudinal-axis of such members, and restrained to slide only in their axial direction by slideways 194,196 within framework 142. At more adjacent ends of the die-holding-members, die-holders 198,200 (FIG. 14) preferably clamps, but may be welds or other common holders, rigidly secure the dies in the proper orientation during the coining and severing fabrication step to form desired rod end configurations. The more distal ends of each die-holding-member communicates with the distal end of an intermediate-member through a cam typical of 202 that transfers axial motion from an intermediate-member to a die-holding-member. Thus in the preferred embodiment, the dies 42,44 are driven together and then apart synchronously during each forward or backward stroke of prime-mover 144.

Cam 202 comprise an obtuse cam-slot 204 within the distal end of intermediate-member 178; and a cam-pin 206 integral with the distal end of die-holding-member 190. The cam-pin is enclosed by the cam-slot so that the axial force in the intermediate member is multiplied and translated to a higher force in a different direction as required for coining and severing.

In light of the above teachings, those skilled in the art could modify components of the preferred embodiment of the mechanical-linkage to drive the dies together and apart. For example, the disclosed members could be replaced by other rigid elongated mechanical means to transfer movement and associated force such as rotating shafts or various combinations of beams; slideways and supporting-members could be replaced by other means of supporting moving mechanical members such as bearings; the cams, including the toggle mechanism, could be replaced by other cam means for translating the direction of motion and providing mechanical advantage such as a cam-surface with follower wheel, other toggle mechanisms, or gear systems. Such modifications and substitutions are within the scope of this invention.

Advantages of the preferred die-drive apparatus include that framework 142 can be made the same thickness as the guillotine cutting apparatus of existing wire-working-machines supplied by Shuster-Mettler or Lewis described above. Thus the die-drive apparatus of the invention is adapted to use in common existing machinery. The disclosed cams are simple, reliable, and easily manufactured, and provide mechanical advantage to produce high forces necessary to die-coin wire in accordance with the invention. The toggle-mechanism provides two die moving cycles for each piston cycle and the die of the invention moves half as far as the prior guillotine shear. Therefore, the die-drive-mechanism embodiment is fast-acting permitting high speed production and minimizing wire feed stop time thus preventing excessive cold-working, wire damage, and wire breaking. Except for the piston, the apparatus can be made simply of bar stock and connecting pins with lubricant supplied between moving parts.

The above-described novel tooling-drive apparatus is a preferred embodiment to enable replacement of prior art cutting mechanism of existing wire-working-machines; while providing the force requirement to die-coin and sever to form two ends simultaneously; to provide fast-action to prevent wire breakage in rotating-arbor type wire straightener or similar wire-straighteners; and to provide reliability, efficiency and long life.

FIG. 15 illustrates a typical narrow metal strip punched with apertures and stamped into an elongated undulating, modified-trapezoidal, wave-shaped grating section 250 for describing a specific application of the invention. The grating defines a row-of-apertures designated 252,254,256, etc., along the top edge 258 of the grating; and a row-of-apertures 260,262,264, etc., is provided along the bottom edge 268 of the grating. Thus when flat-wire gratings, which are laterally-adjacent are partially fitted together, apertures in laterally-adjacent edges can be aligned for or by a rod pushed through the apertures (see FIG. 16). The flat-wire gratings forming hinge-joints at each such pair of interfitting grating sections to assemble a continuous-length metal belt in the direction of assembly as shown.

Finishing apertures 270,272 are provided at grating ends, when clinch-finishing, to enable rod ends to be bent into such finishing apertures to clinch belt edges (as in FIG. 16 described below).

Angles typical of 274,276,278,280 are 90° so that contact surfaces typical of 282,284 between adjacent gratings are perpendicular to the hinge-joints between adjacent gratings and thus remain parallel as grating rotates about the hinge-joints. Oblique sections typical of 286 connected by angles 288,290 provide that wave-bottoms are wider than wave-tops so that wave-tops fit into wave-bottoms of laterally adjoining grates.

In FIG. 16, a typical section of metal belt 300 comprises multiple gratings of FIG. 15 typical of 250,302,304 hinged together by rods typical of 306,308 each rod having two die-coined convex tapered ends with truncated tips. For adjacent gratings typical of 302,200, the waves partially fit together so that the rows-of-apertures along adjacent lateral edges (in FIG. 15 described above) align thus enabling rod 306 to be pushed through aligned apertures to weave the adjoining gratings together to form a hinge-joint that connects the gratings into a continuous metal belt.

Sprocket-wheels (not shown) interact with openings in the belt typical of 258 defined by the modified trapezoidal wave-shape such that the sprocket-wheels support and drive the belt.

In a common type of belt edge finish rod ends are bent typical of 310 at the belt edge into finishing apertures (270,272 of FIG. 15) at the ends of gratings and further bent 312 to clinch the belt edge with the rod ends.

Such rod ends are configured with tapered convex points in order to automatically correct any minor misalignment of the apertures as the rod is weaved between gratings to assemble the belt. Both rod ends are pointed to simplify rod handling during belt assembly and because points help align the rod with the finishing apertures during clinch type finishing. Thus assembly is simpler, faster, and may be automated as a result of the invention.

While the invention has been particularly illustrated and described with reference to preferred embodiments, it will be understood by those skilled in the art that changes in form and detail can depart from such embodiments without departing from the spirit and scope of the invention.

We claim:

1. Method for severing continuous-length metal wire into segments of predetermined length while die-coining a pair of longitudinally-convex tapered configuration ends contiguous to the location at which severing occurs, comprising supplying metal wire in continuous-length form, such wire having a leading longitudinal end and a central longitudinal axis;

delivering such wire to move substantially in the direction of its central longitudinal axis;

measuring a predetermined length from the leading longitudinal end of such continuous-length wire for segmenting by simultaneously severing and die-coining metal at such measured length;

providing a pair of elongated tooling dies having a longitudinally extending central axis and peripheral outer surface with a working end located at one longitudinal end of each respective elongated tooling die, each working end presenting four severing edges which are coplanar at the distal edge of the working end and separated by die-coining regions in the tooling which recess from such distal edges in the longitudinal direction of the elongated die with each severing edge being offset with respect to each other and the location of such central axis in such distal edge, positioning the pair of tooling dies with the working end for one tooling die of such pair being oriented in confronting relationship to the working end of the remaining tooling die of such pair with severing edges of one die juxtaposed oppositely to corresponding severing edges of the remaining die in mirror-image confronting orientation for coaction of such working ends during relative movement of such dies toward each other from opposite lateral sides of the metal wire;

orienting the metal wire to move between the confronting working ends of the pair of tooling dies so as to enable severing a metal wire segment with such severing occurring at the location of such measured predetermined length, and moving the confronting working ends of the pair of tooling dies toward each other from opposite lateral sides of the metal wire, such movement of the confronting working ends toward each other being in a direction transverse to the central longitudinal axis of the metal wire with severing edges simultaneously severing such wire as metal is coined in such intermediate die-coining regions, such movement of the confronting working ends toward each other forming a pair of longitudinally contiguous die coined ends each having a substantially-identical longitudinally-convex four-sided tapered configuration on longitudinally opposite sides of the location at which such segment is severed, with one of the pair of die-coined ends being on the trailing longitudinal end of the severed segment produced, and the remaining die-coined end of such pair being on the leading longitudinal end of the metal wire for the next segment to be severed.

2. The method of claim 1 in which such continuous-length metal wire is supplied in coils, further including the steps of uncoiling the wire, and straightening such wire as uncoiled for such die-coining and severing step so as to produce longitudinally-straight substantially-rigid metal rods of such predetermined length.

3. The method of claim 2 in which the metal wire is straightened before such step of measuring a predetermined length, and the confronting working ends of such pair of tooling dies are moved toward each other along rectilinear travel paths which meet in perpendicularly transverse relationship to the central longitudinal axis of the straightened wire.

4. The method of claim 3 in which both such dies are moved simultaneously toward each other and simultaneously retracted into position for a subsequent die coining and severing operation, with both such dies being driven with confronting working ends approaching the central longitudinal axis of the metal wire to cause severance thereof, and, then being immediately retracted toward a position for the subsequent die coining and severing operation as such continuous-length wire continues to be delivered in the direction of its central longitudinal axis.

5. Production-line system for severing continuous-length metal wire into segments of predetermined length having desired die-coined longitudinal end configurations, one each on longitudinally opposite sides of and contiguous to the location at which severing of the metal wire occurs, comprising means supplying continuous-length metal wire;

wire drive means for moving such wire in the direction of its central longitudinal axis into at least partially through such system;

measuring means for measuring to preselected dimension from a leading longitudinal end of such metal wire to predetermine the length of the wire segments to be severed;

a pair of elongated tooling dies each with die-coining surface and severing-edge means at a single longitudinal end thereof presenting a working end, each such working end presenting four coplanar severing edges at its distal edge with intermediate longitudinally-recessed die-coining regions with each severing edge being offset with respect to each other and the location of such central axis in such distal edge, the pair of tooling dies being mounted with working ends in confronting relationship for coacting movement toward each other to simultaneously die-coin and sever such metal wire to form a longitudinally-contiguous pair of longitudinally-convex four-sided, tapered, die-coined ends of substantially-identical configuration, with one each of such working ends being on longitudinally opposite sides of the location at which the metal wire is to be severed;

tooling-die operating means for carrying out such simultaneous die-coining and severing operation, the tooling die operating means including:

tooling die positioning means for positioning and holding the pair of tooling dies with respective working ends in mirror-image, confronting orientation, and wire positioning means for guiding travel of the metal wire in the direction of its central longitudinal axis such that movement of the confronting working ends of the tooling dies toward each other into contact with the meal wire causes simultaneous die-coining and severing a predetermined-length segment.

6. The system of claim 5 in which the tooling die operating means includes tooling-drive apparatus, and a prime mover for such tooling-drive apparatus;

such tooling-drive apparatus converting a single-direction output power stroke of the prime mover into reciprocal motion of such tooling dies;

such reciprocal motion, including die-coining and severing the metal wire by driving the confronting working ends of the pair of tooling dies toward each other in a direction transverse to the central longitudinal axis of the wire, and, as such severing occurs retracting the pair of tooling dies by driving such pair of working ends apart to a position for a subsequent single-direction output power stroke for subsequent simultaneous die-coining and severing operation.

7. The system of claim 6 in which such supply of continuous-length metal wire is in coil form; further including:

uncoiled means for such wire, wire-straightener means for establishing the uncoiled wire in a substantially-rigid, straight line configuration for die-coining and severing a rod of predetermined length, and control means for coordinating operation of components of such production-line systems, such control means communicating with such measuring means, wire positioning means and tooling-die operating means in order to activate the tooling-drive apparatus in coordination with positioning of the metal wire between the pair of tooling die working ends for such die-coining and severing operation of such predetermined length segment.

8. A method for severing continuous-length metal wire into segments of predetermined length while die-coining a pair of longitudinally-convex tapered configuration ends contiguous to the location at which severing occurs with one each of such pair of die-coined ends being on longitudinally opposite sides of such location, comprising supplying metal wire in continuous-length form, such wire having a leading longitudinal end and a central longitudinal axis;

providing a pair of elongated tooling dies each presenting die-coining and severing means at its working end located at one longitudinal end of each respective elongated tooling die; the severing means on each die consisting of four cutting edges, all of such plurality of cutting edges of each die being coplanar at the distal working end of each such die with each cutting edge being offset with respect to each other and the location of such central axis in such distal end;

positioning the pair of tooling dies with the working end for one tooling die of such pair being oriented in confronting relationship to the working end of the remaining tooling die of such pair for coaction of such working ends during relative movement of such dies toward each other from opposite lateral sides of the metal wire;

orienting the metal wire to move in the direction of its central longitudinal axis between the confronting working ends of the pair of tooling dies so as to enable severing a metal wire segment with such severing taking place such that the distal end of the longitudinally-convex tapered configuration occurs at the location of such measured predetermined length, and moving the confronting working ends of the pair of tooling dies toward each other from opposite lateral sides of the metal wire, such movement of the confronting working ends toward each other being in a direction transverse to the central longitudinal axis of the metal wire so as to simultaneously die-coin and sever such wire causing die-coined pieces of predetermined shape to be severed from sides of such wire extending from such central longitudinal axis in a direction to form a substantially identical convex tapered shape on each longitudinal side of the severing location.

* * * * *

UNITED STATES PATENT AND TRADEMARK OFFICE

CERTIFICATE OF CORRECTION

PATENT NO. : 5,207,084

DATED : May 4, 1993

INVENTOR(S) : H. William West; Millard F. Vannoy, Jr.

It is certified that error appears in the above-indentified patent and that said Letters Patent is hereby corrected as shown below:

In Column 3, line 14 of the Patent, cancel "longitudinally sides" and substitute -- longitudinal side --.

In Column 4, line 2 of the Patent, after "figures" cancel "; during" and substitute -- . During --; line 5 of the Patent, after "fact" insert -- , --; line 6 of the Patent, after "end" insert -- , --; line 10 of the Patent, after "positions" cancel ";" and substitute -- . --; line 11 of the Patent, before "practice" cancel "in" and substitute --In--, after "severance" insert -- , --; line 49 of the Patent, after "point" cancel "," and substitute -- . --; line 50 of the Patent, before "forms" cancel "this" and substitute -- This --.

In Column 5, line 15 of the Patent, after "Preferably" insert ","; line 36 of the Patent, before "from" insert -- ( --, after "above" insert -- during movement) --; line 38 of the Patent, cancel ";" and substitute -- , --; line 51 of the Patent, cancel "coining-region between" and substitute -- coining regions, extending from --; line 52 of the Patent, after "106" cancel "and" and substitute -- , 108 toward the diameter represented by --, after "101" insert -- , --; line 54 of the Patent, after "120" and before "." insert -- , as best indicated in FIG. 9, in which plane 121 is parallel to the central-longitudinal-axis of the tooling die --, and after "116" insert -- , 118 --; line 56 of the Patent, cancel "parallel"; line 57 of the Patent, cancel "to the central-longitudinal-axis of the tooling die".

UNITED STATES PATENT AND TRADEMARK OFFICE

CERTIFICATE OF CORRECTION

PATENT NO. : 5,207,084

DATED : May 4, 1993

INVENTOR(S) : H. William West; Millard F. Vannoy, Jr.

It is certified that error appears in the above-indentified patent and that said Letters Patent is hereby corrected as shown below:

In Column 6, line 54 of the Patent, after "members" and before "." insert -- at each end --, cancel "Each supporting-" and substitute -- Such supporting- --; line 55 of the Patent, cancel "member typically" and substitute -- members at each end --, cancel "comprises" and substitute -- comprise --, after "beams" insert -- , such as --, after "172," cancel "each" and substitute -- such --; line 56 of the Patent, cancel "beam" and substitute -- beams --, after "hinged" insert -- at --, after "174" cancel "to" and substitute -- within stationary --; after "142" cancel ", and the" and substitute -- with --; line 57 of the Patent, after "hinged" insert -- at --; line 61 of the Patent, after "are" insert -- of --, after "parallel" insert -- , --; line 68 of the Patent, cancel "typical of" and substitute -- such as --.

In Column 7, line 4 of the Patent, after "toggle-means" cancel "typical of" and substitute -- such as indicated generally at --; lines 4-5 of the Patent, after "184" cancel "comprising a toggle-member, shown" and substitute -- in FIGS. 13, 14, with toggle-members, such --, cancel "beams", after "188" cancel ",", after "hinged" insert -- at --, after "176" cancel "at" and substitute -- to --; line 6 of the Patent, after "hinged" insert -- at --, after "190" cancel "at" and substitute -- to --; line 12 of the Patent, cancel "toggle-member" and substitute -- toggle-members --; line 24 of the Patent, after "but" insert -- which --; lines 29-30 of the Patent, cancel "typical of" and substitute -- such as --; line 35 of the Patent, cancel "comprise" and substitute -- comprises --, after "204" insert -- (FIG. 13) --; line 59 of the Patent, after "that" insert -- stationary --.

UNITED STATES PATENT AND TRADEMARK OFFICE

CERTIFICATE OF CORRECTION

PATENT NO. : 5,207,084

DATED : May 4, 1993

INVENTOR(S) : H. William West; Millard F. Vannoy, Jr.

It is certified that error appears in the above-indentified patent and that said Letters Patent is hereby corrected as shown below:

In Column 8, line 12 of the Patent, cancel ";"; line 13 of the Patent, cancel ";" and substitute -- and --; line 45 of the Patent, cancel "a typical section of", after "belt" insert -- section --; line 46 of the Patent, after "gratings" insert -- 250, 302, 304 --, after "of" and before "Figure" insert -- the --, cancel "typical of"; line 47 of the Patent, cancel "250, 302, 304" and substitute -- wave-shaped configuration --, cancel "typical of" and substitute -- such as --, after "308" insert -- ; --; line 49 of the Patent, cancel "of"; line 50 of the Patent, cancel "waves" and substitute -- wave shapes --; line 57 of the Patent, cancel "typical of" and substitute -- such as --; line 61 of the Patent, cancel "typical of" and substitute -- as shown at --; line 63 of the Patent, after "bent" insert -- at --.

Signed and Sealed this

Twenty-fifth Day of January, 1994

*Attest:*

Bruce Lehman

BRUCE LEHMAN

*Attesting Officer*

*Commissioner of Patents and Trademarks*